US008180081B2

(12) United States Patent
Lunner

(10) Patent No.: US 8,180,081 B2
(45) Date of Patent: May 15, 2012

(54) SYSTEM AND METHOD FOR ELIMINATING FEEDBACK AND NOISE IN A HEARING DEVICE

(75) Inventor: Thomas Lunner, Smørum (DK)

(73) Assignee: Oticon A/S, Smorum (DK)

( * ) Notice: Subject to any disclaimer, the term of this patent is extended or adjusted under 35 U.S.C. 154(b) by 1119 days.

(21) Appl. No.: 11/922,854

(22) PCT Filed: Jun. 29, 2006

(86) PCT No.: PCT/EP2006/063688

§ 371 (c)(1),
(2), (4) Date: Feb. 22, 2008

(87) PCT Pub. No.: WO2007/006658

PCT Pub. Date: Jan. 18, 2007

(65) Prior Publication Data

US 2009/0034768 A1 Feb. 5, 2009

(30) Foreign Application Priority Data

Jul. 8, 2005 (EP) ..... 05106277

(51) Int. Cl.
*H04R 25/00* (2006.01)

(52) U.S. Cl. ..... 381/318; 381/60; 381/312; 381/316; 381/317; 600/25; 607/55; 607/57

(58) Field of Classification Search ..... 381/60, 381/312–331; 600/25; 607/55, 57
See application file for complete search history.

(56) References Cited

U.S. PATENT DOCUMENTS

| | | | |
|---|---|---|---|
| 5,305,307 | A | 4/1994 | Chu et al. |
| 2004/0264721 | A1 | 12/2004 | Allegro et al. |

FOREIGN PATENT DOCUMENTS

| | | | |
|---|---|---|---|
| EP | 0 443 547 | A | 8/1991 |
| EP | 0 579 152 | A | 1/1994 |
| WO | WO-98/47313 | A | 10/1998 |
| WO | WO-99/53612 | A | 10/1999 |

*Primary Examiner* — Matthew E Warren
*Assistant Examiner* — John Lin
(74) *Attorney, Agent, or Firm* — Birch, Stewart, Kolasch & Birch, LLP

(57) ABSTRACT

This invention relates to a system (100) and method for synthesizing an audio input signal of a hearing device. The system (100) comprises a microphone unit (102) for converting the audio input signal to an electric signal, a filter unit (110) for removing a selected frequency band of the electric signal and pass a filtered signal, a synthesizer unit (118) for synthesizing the selected frequency band of the electric signal based on the filtered signal thereby generating a synthesized signal, a combiner unit (120) for combining the filtered signal and the synthesized signal so as to generate a combined signal, and finally an output unit (122, 124, 126) for converting the combined signal to an audio output signal.

28 Claims, 8 Drawing Sheets

SYSTEM AND METHOD FOR ELIMINATING FEEDBACK AND NOISE IN A HEARING DEVICE

FIELD OF INVENTION

This invention relates to a system and method for eliminating acoustical feedback and noise in a hearing device such as a hearing aid, headset or head-phone. In particular, this invention relates to a hearing aid such as a behind-the-ear (BTE), in-the-ear (ITE) or completely-in-canal (CIC) hearing aid, wherein undesirable acoustical feedback from the speaker to the microphone is eliminated together with noise.

BACKGROUND OF INVENTION

Acoustic feedback and external noise in hearing aids are problems, which have been compensated in a number of ways in the prior art.

In regards to acoustical feedback several known methods are used for reducing the negative effects introduced by acoustic feedback in a hearing aid, this includes notch filtering, frequency compression, modification of the phase response, and feedback cancellation, such as disclosed in M. Sc. Thesis entitled "Digital suppression of acoustic feedback in hearing aids" written by Best L. C. and written for the Department of Electrical Engineering, University of Wyoming, 1985.

Best's thesis describes a method using a least-mean-square (LMS) filter technique for estimating external acoustic feedback, which estimate is used for feedback cancellation in a hearing aid. The estimate is subtracted from the input signal thus removing the acoustic feedback.

Further, in European patent application no.: EP 1 216 598 several prior art systems attempting to eliminate unstable feedback in hearing aids are presented and their disadvantages considered. The European patent application therefore suggests a system for overcoming these disadvantages, which system comprises a signal processor processing an audio input signal including a feedback component associated with an acoustic feedback path, and comprises a detector detecting the feedback component and issuing a feedback indicator parameter signal to a probe generator generating a narrow-band probed signal to probe the acoustic feedback path. The system further comprises a feedback-inhibiting filter controlled by a filter adjuster in accordance with the feedback indicator parameter signal received by the detector. Hence the system utilises a high signal-to-noise sub-audible probe signal to establish the extent of the acoustic feedback of the system and adjusts the feedback-inhibiting filter accordingly. Even though this system reduces the effects of acoustic feedback, filtering of the incoming signal to remove acoustic feedback distorts the acoustic sounds to be presented to the user of the hearing aid, since the feedback-inhibiting filter removes some of the original signal in the process, which is not restored. In addition, this feedback cancellation technique relies on a high degree of accuracy of the estimation of the potentially dynamic, external acoustic feedback. Erroneous estimations of the acoustic feedback introduce audible distortions to the original input signal due to the subtraction.

Further, Ph. D. thesis entitled "Compensation for hearing loss and cancellation of acoustic feedback in digital hearing aids" written by Hellgren, J and written for Linköping Studies in Science and Technology reveals feedback cancellation techniques using the input signal as well as the output signals to estimate the acoustic feedback path are sensitive to signals that are correlated between the input. For example music with tonal inputs may cause the feedback cancellation system to try to cancel the tonal parts of the music thus degrading sound quality for the user of a hearing aid.

In light of above reference prior art there is a need for feedback cancellation systems and methods for removing more of the acoustic feedback, ideally completely removing the acoustic feedback, which systems and methods avoid the introduction of audible distortions.

In regards to noise reduction, "Noise reduction in hearing aids: What works and why" and article written by Donald Schum and published in News from Oticon, April 2003, provides a review of state of the art noise reduction techniques in hearing devices. Several of the digital signal processor (DSP) based instruments on the market implement variations of modulation detection for classifying the input as either speech or noise. According to this scheme, the on-going amplitude modulations of the input signal are monitored. Speech in quiet is known to have relatively deep (15 dB or greater) modulations at a rate between approximately 3 to 10 Hz. This modulation pattern reflects the syllabic structure of speech: 3 to 6 syllables per second. In contrast, certain environmental sounds tend to be more stable in terms of on-going amplitude. It is unusual for a non-speech noise source to have a modulation rate and depth similar to that of speech.

As implemented in hearing aids, the input is divided into multiple channels. The modulation behaviour is monitored in each channel. If the modulation rate and depth is similar to speech, then that channel is passed without gain reduction. If the modulation behaviour in the channel is more stable, it is assumed that that channel is dominated by steady state noise and gain reductions are applied. However, this may introduce a distortion of the original speech signal in presence of noise, since the noise-dominated channels/bands are attenuated if they are classified as noisy. Therefore, there is a need for systems and methods that reduces noise without attenuating the speech part in the channels that has been classified as noisy.

SUMMARY OF THE INVENTION

An object of the present invention is to provide a system and method for overcoming the problems described with reference to the prior art. In particular, it is an object of the present invention to provide a hearing device wherein acoustic feedback is eliminated contrary to being reduced.

It is a further object of the present invention to provide a hearing device for reducing noise in the output presented to a user of the hearing device.

A particular advantage of the present invention is the provision of means for re-synthesizing all or parts of an incoming signal and therefore the incoming signal may be re-established before communicated to a user of the hearing device.

A particular feature of the present invention is the provision of a noise detection means for detecting noise and removing the noise in the incoming signal.

The above objects, advantage and feature together with numerous other objects, advantages and features, which will become evident from below detailed description, are obtained according to a first aspect of the present invention by a system for synthesizing an audio input signal of a hearing device and comprising a microphone unit adapted to convert said audio input signal to an electric signal, a filter unit adapted to remove a selected frequency band of said electric signal and pass a filtered signal, a synthesizer unit adapted to synthesize said selected frequency band of said electric signal based on said filtered signal thereby generating a synthesized signal, a combiner unit adapted to combine said filtered signal and said synthesized signal thereby generating a combined signal, and an output unit adapted to convert said combined signal to an audio output signal.

The term "hearing device" is in this context to be construed as a hearing aid, a headset, a head-phone and similar microphone-amplifier-speaker devices.

The term "process" is in this context to be construed as any signal processing aiming to enhance the input signal to provide an output signal according to individual user's needs. In particular, this may involve constant gain or input level dependent gain (amplitude compression) in any frequency bands within the signal. The term "amplitude compression" (or just "compression") is in this context to be construed as performing level dependent gain. In particular, in hearing impairment with cochlear origin the dynamic range between the weakest detectable sounds (hearing thresholds) and the loudest sounds (uncomfortable loudness levels) is typically less than for normal hearing persons. Usually this narrowing of the dynamic range is also frequency dependent. Furthermore, the hearing thresholds are more affected by hearing impairment than the uncomfortable loudness levels. Therefore, there can be a need to amplify weak input sounds more than loud sounds, hence to "compress" the input level dynamic range to the output dynamic range.

By removing a selected frequency band in the incoming electric signal acoustic feedback between the output unit and the microphone or noise in a particularly frequency band is effectively eliminated. The synthesized signal may be acoustically fed back to the microphone, but since it is removed from the electric signal by the filter unit it is irrelevant. One could say that the selected frequency band is muted in the hearing device and synthesized restoring the original audio input.

In fact, by selecting a frequency band showing a tendency to becoming noisy the system further advantageously eliminates this external noise by cutting out the noisy frequencies and synthesizing these frequencies. This solution provides a unique way to completely avoid acoustic feedback and noise in audio devices prone for these problems, such as in particular hearing aids.

The filter unit according to the first aspect of the present invention may be configured as a low-pass, a high-pass, a band-pass, a notch filter, or any combination thereof. Hence any frequencies or frequency bands may be removed. The filter unit may further be configured as an $n^{th}$ order finite or infinite impulse response (IIR) filter (such as a $2^{nd}$, $3^{rd}$, or $4^{th}$ order Chebychev or Butterworth), a wave-digital, or any combination thereof. Alternatively, the filter unit may be configured as a filter bank muting selected frequency bins of a frequency transformation, such as fast Fourier transformation (FFT), discrete Fourier transformation (DFT) or discrete cosine transformation (DCT). In this context the term "muting" is to be construed as attenuating or eliminating a signal. Accordingly, the filter unit may be configured so as to cut away any frequencies or frequency bands without introducing significant errors in the passed frequency bands.

The system according to the first aspect of the present invention may further comprise an amplifier unit interconnecting the combiner unit and the output unit, and adapted to process the combined signal before communicating the combined signal to the output unit. Alternatively, the system may comprise an amplifier unit interconnecting the filter unit and the combiner unit, and adapted to process the filtered signal before communicating the filtered signal to the combiner unit and/or the synthesizer unit. Hence the amplifier unit may process the combined signal directly or may process the filtered signal and rely on the synthesizer unit to process the synthesized signal accordingly before communicating to the combiner unit.

The amplifier unit according to the first aspect of the present invention may comprise a digital signal processor. The digital signal processor may comprise a frequency selecting means adapted to select a processing frequency band of the filtered signal and an adjusting means adapted to increase or compress gain in the processing frequency band. The frequency selecting means may comprise a filter bank element adapted to separate the electric signal into a plurality of time varying electric sub-signals. The adjusting means may thus separately increase or compress gain of each of the plurality of time varying electric sub-signals in accordance with a predefined setting. Hence the amplifier unit may comprise a series of functionalities such as filtering the incoming signals to a plurality of frequency bands by means of a filter bank, equalising the filtered signal or combined signal in accordance with a particular audio requirement or processing setting i.e. amplifying some frequency bands and compressing other.

The system according to the first aspect of the present invention may further comprise an encoder unit interconnecting the microphone unit and the filter unit, and may be adapted to code the electric signal to a code signal. The encoder unit may comprise a converter element adapted to convert the electric signal form analogue to digital form and may comprise a coding element adapted to transform the electric signal from a time domain to a frequency domain. The encoder element may comprise a time-to-frequency transformer such as a fast Fourier transformation (FFT) element, a discrete Fourier transformation (DFT) element, or discrete cosine transformation (DCT) element. Thus the resultant electric signal may comprise a coded signal representing frequency content of the electric signal. By transforming the electric signal into the frequency domain the amplifier unit may perform detailed manipulations of the signal. The output of the time-to frequency transformer may then be fed both to the synthesizer unit and the amplifier unit.

Obviously, the encoder unit may code the electric signal according to a number of various coding schemes allowing for detailed processing of the signals. That is, the encoder may code the electric signal to any form of digital signal having any number of bits and describing the electric signal in any terms of parameters, which may be processed by the signal processor, such parameter definitions as frequency, amplitude, transition etc. in the time or frequency domain.

The width of the analysis filter bank or the number of bins in the encoder may be made dependent on the amount of hearing impairment of the individual user.

The output unit according to the first aspect of the present invention may comprise a decoder unit adapted to decode the combined signal to a decoded signal. The decode unit may comprise a converter element adapted to convert the coded signal from digital to analogue and may comprise a decoding element adapted to transform the combined signal from a frequency domain to a time domain. The decoder element may comprise a frequency-to-time transformer such as an inverse FFT, DFT or DCT element adapted to transform the combined signal from the frequency domain into the time domain, and a driver adapted to drive a speaker to provide the audio output signal.

As before regarding the encoder unit, the decoder unit may decode the combined signal according to a number of various coding schemes used for the detailed processing of the signals. That is, the decoder may decode the combined signal from any form of digital signal having any number of bits and describing the electric signal in any terms of parameters, which may be processed by the signal processor, such parameter definitions as frequency, amplitude, transition etc. in the time or frequency domain.

The encoder may utilize a filter bank analysis, modulation to zero frequency and sampling rate decimation and the encoder unit may utilize complex band shifting to obtain complex sub-bands. The decoder may utilize filter bank synthesis and interpolation to convert to reconstruct an output signal from a sub-band signal, and the reconstruction may include complex band shifting in the reconstruction.

The synthesizer unit according to the first aspect of the present invention may comprise a calculation element adapted to calculate harmonic frequencies in the selected frequency band of a selected reference frequency in a defined frequency band of the filtered signal, and a generator element adapted to transpose the defined frequency band to harmonic frequencies in the selected frequency band thereby generating the synthesized signal. The filtered signal may comprise any number of defined frequency bands each being transposed in relation to an associated selected reference frequency. The selected reference frequency may be the centre frequency of the defined frequency band, or the lower or higher cut-off frequency of the defined frequency band. By pre-defining a number of frequency bands in the filtered signal and utilising associated reference frequencies to transpose the frequency bands to higher harmonics of the associated reference frequencies the synthesizer unit may advantageously reconstruct a combined signal of the filtered signal and the synthesized signal. Hence by utilising the implicitly present information in the filtered signal for calculating the second and higher order harmonics of selected reference frequencies in the filtered signal the signal parts of the selected frequency band, which are cut out of the original audio input signal, may be synthesized. The synthesizer unit advantageously utilises transposition as a spectral replication process thereby avoiding dissonance-related artefacts in the synthesize signal.

The term "transpose" or "transposition" is in this context to be construed as band-shifting of frequency bands or as a transfer of partials from one frequency spectrum position to another while maintaining frequency ratios of partials. That is moving content of a first frequency band to a higher or lower frequency area.

The synthesizer unit further may utilise extrapolation for the determination of the frequency spectral envelope of the filtered signal. For example, the synthesizer unit may extrapolate by using polynomials together with a set of rules establishing source data. The set of rules may include information regarding gain transfer function of the entire frequency spectrum of the electric signal. That is, the set of rules may include information whether the synthesized signal requires amplification.

Alternatively, the synthesizer unit according to the first aspect of the present invention may comprise a calculation element adapted to calculate an estimated frequency response of the selected frequency band from a complementary signal from the filter unit, which complementary signal comprises filtered out part the filtered signal. The estimated frequency response may be calculated from running average of the frequency response in the entire frequency bandwidth of the system, or of the selected frequency band. The synthesizer unit further may comprise a generator element adapted to generate a synthesized signal represented by the estimated frequency response.

The digital signal processor according to the present invention may incorporate the synthesizer unit, and the system may further comprise a controller processor adapted to control the amplifier unit and the synthesis unit, according to a predefined setting. The term "setting" is in this context to be construed as a program, a process or a method for processing data. The controller processor may thus ensure that the amplifier unit and synthesizer unit operate according to for example a user's hearing impairment as well as actual acoustic environment.

The system according to the first aspect of the present invention may further comprise a detector unit having an acoustic feedback detector adapted to monitor an anti-feedback unit adapted to identify acoustic feedback, and having a control signal generator adapted to generate a control signal for the filter unit for controlling the selected frequency band. The acoustic feedback detector may comprise one or more pure-tone detectors. The detector unit may thus retrieve information from the anti-feedback unit regarding acoustic feedback in the system and generate a control signal to the filter unit thereby determining the selected frequency band so as to cut out frequencies of the electric signal, which have a tendency to generate acoustic feedback. Alternatively or additionally, the detector unit may incorporate a pre-defined frequency band in which the hearing device is more prone to acoustic feedback, and further may communicate the control signal to the controller processor selecting a setting according to the control signal. Hence settings stored in a memory connecting to the controller processor may be associated with a frequency band in which the system is prone to acoustic feedback. Hence the system advantageously removes the acoustic feedback by filtering away a selected part of the frequency spectrum in which the acoustic feedback occurs. The synthesizer unit subsequently may utilise the filtered signal to restore second and more harmonics of the filtered signal in the cut out frequency band.

The detector unit according to the first aspect of the present invention may further comprise a noise detector adapted to identify external noise and wherein the control signal generator may further be adapted to generate the control signal for the filter unit according to the external noise. The noise detector may use modulation behaviour of a given frequency band to classify the frequency band as noisy. The noise detector thus provides a unique way of eliminating noise in particular frequency bands by removing part of the electric signal in the selected frequency band and synthesizing the signal subsequently as described above by synthesizing second or more harmonic frequency bands of the filtered signal in the selected frequency band. Thus the external noise is completely removed providing an improved overall sound quality for the user of the hearing device.

The detector unit according to the first aspect of the present invention may comprise a music detecting element adapted to detect music in the electric signal. The music detecting element may be based on harmonicity detector elements, periodicity calculations, calculation of cepstrum flux, spectral centroid estimates or vibrato detectors. The music detecting element may advantageously be used to disable ordinary acoustic feedback cancellation techniques when music is detected and enable the filter and synthesizer units for ensuring no acoustic feedback. Music generally may provoke ordinary acoustic feedback cancellation since the tonal content of the audio signal in some instances is recognized by the anti-feedback unit as acoustic feedback, whereafter the anti-feedback unit may seek to remove this tonal content from the processed audio signal.

The above objects, advantages and features together with numerous other objects, advantages and features, which will become evident from below detailed description, are obtained according to a second aspect of the present invention by a synthesizer unit for synthesizing a selected frequency band of an electric signal based on a filtered signal for use in a system according to the first aspect of the present invention.

The above objects, advantages and features together with numerous other objects, advantages and features, which will become evident from below detailed description, are obtained according to a third aspect of the present invention by a method system for synthesizing an audio input signal of a hearing device and comprising converting said audio input signal to an electric signal by means of a microphone unit, removing a selected frequency band of said electric signal and passing a filtered signal by means of a filter unit, synthesizing said selected frequency band of said electric signal based on said filtered signal thereby generating a synthesized signal by means of a synthesizer unit, combining said filtered signal and said synthesized signal thereby generating a combined signal by means of a combiner unit, and converting said combined signal to an audio output signal by means of an output unit.

The above objects, advantages and features together with numerous other objects, advantages and features, which will become evident from below detailed description, are obtained according to a fourth aspect of the present invention by a computer program to be run on a system according to the first aspect of the present invention and comprising steps of the method according to the second aspect of the present invention.

The synthesizer unit according to the second aspect, the method according to the third aspect and the computer program according to the fourth aspect of the present invention may incorporate any features of the system according to the first aspect of the present invention.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawing, wherein:

FIGS. 2*a* through 2*g*, show graphs of signals described with reference to the system according to the first embodiment of the present invention and shown in FIG. 1;

DETAILED DESCRIPTION OF PREFERRED EMBODIMENTS

In the following description of the various embodiments, reference is made to the accompanying figures, which show by way of illustration how the invention may be practiced. It is to be understood that other embodiments may be utilized and that structural and functional modifications may be made without departing from the scope of the present invention.

Figure 1:
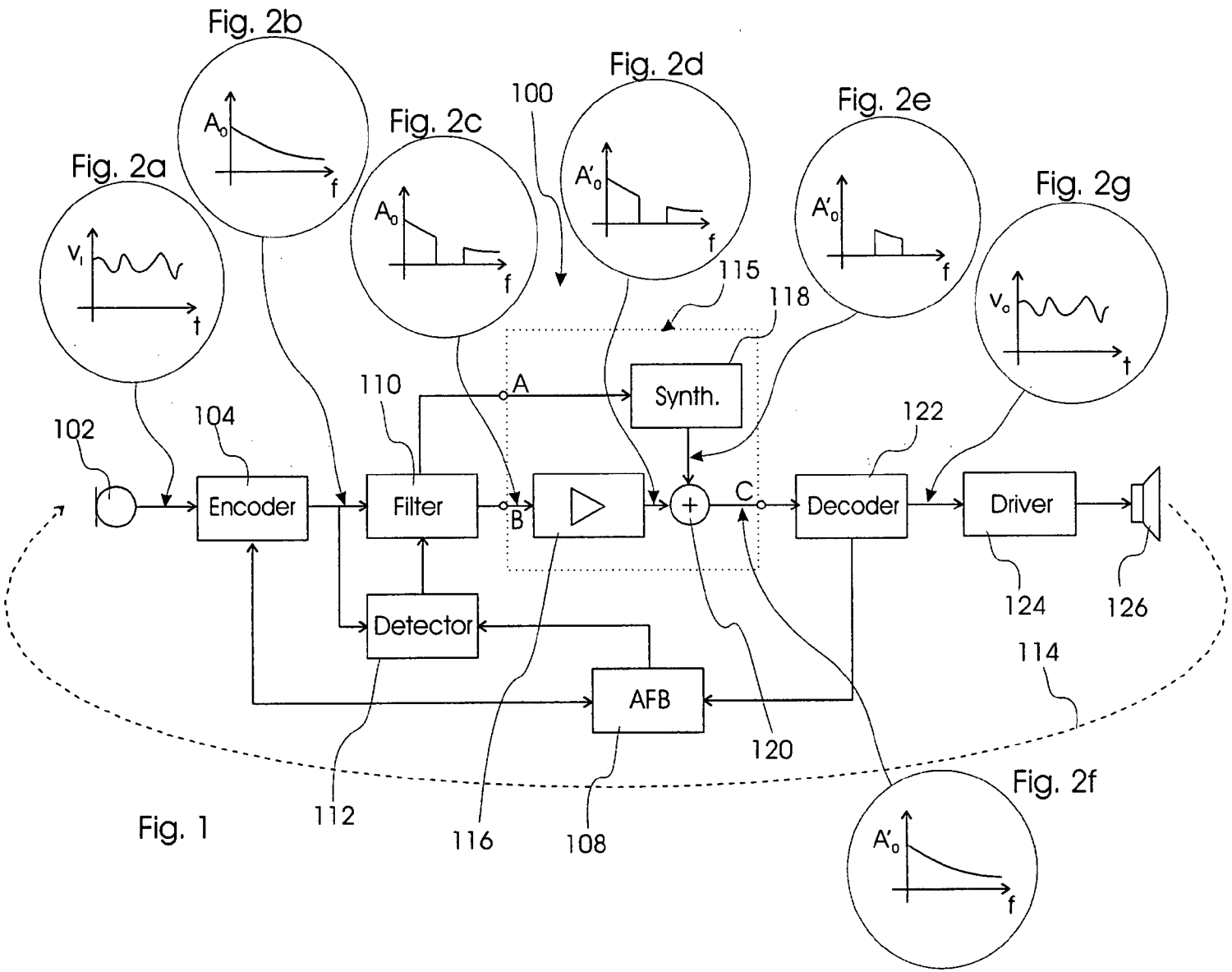
FIG. 1, shows a system for synthesizing an audio input signal of a hearing device according to a first embodiment of the present invention.

FIG. 1 shows a system for synthesizing an audio input signal according to a first embodiment of the present invention, which system is designated in entirety by reference numeral 100. The system 100 comprises a microphone 102 converting a sound pressure into a time varying electric signal, for example such as shown in FIG. 2*a*. The description relating to FIGS. 2*a* through 2*f* is incorporated in the description relating to FIG. 1.

Obviously, the system 100 may comprise any number of microphones such as two or more used for determining a directionality function. However, the following description and figures show only one microphone 102 for simplicity.

The sound pressure forms an audio input signal, which is converted by the microphone 102 to the electric signal and communicated to an encoder 104. The term "encoder" is in this context be construed as a transforming, encoding and/or converting element.

The encoder 104 according to the first embodiment of the present invention comprises a low pas filter element for filtering low frequency parts out of the electric signal, an analogue to digital converter element for converting the electric signal from analogue to digital form as well as a discrete Fourier transformation element (DFT) for transforming the electric signal in the time domain, shown in FIG. 2*a*, to a coded signal in the frequency domain, shown in FIG. 2*b*. It should be noted that FIGS. 2*a* through 2*f* entirely are illustrative for the functioning of the system 100, that is, the transformation of the electric signal from the microphone 102 in the time domain into the coded signal from the encoder 104, shown in FIG. 2*b*, is by no means an accurate result of a discrete Fourier transformation.

The encoder 104 according to the first embodiment of the present invention further comprises a first combiner element for combining the electric or coded signal, shown in FIGS. 2*a* and 2*b*, or any intermediate signal there between, with a possible feedback signal from an anti-feedback unit 108. That is, the first combiner element provides the possible feedback signal to the electric signal; the low passed electric signal; the converted electric signal; or the coded signal depending on the format of the feedback signal.

The anti-feedback unit 108 according to the first embodiment of the present invention identifies acoustic feedback and simulates the acoustic feedback by generating the feedback signal, which is subtracted in the first combiner element from the electric signal, the low passed electric signal, the converted electric signal, or the coded signal thereby cancelling the acoustic feedback in the forward signal path. However, a particular advantage of the present invention is that the anti-feedback unit 108 further generates an anti-feedback signal, which is communicated to a detector 112. The anti-feedback unit 108 is therefore not entirely used for generating the feedback signal, but also for identification purposes. Hence when the anti-feedback unit 108 detects acoustic feedback it generates an anti-feedback signal, which is forwarded to the detector 112.

The anti-feedback unit 108 according to the first embodiment of the present invention comprises a switching element for switching between a first mode of operation during which the anti-feedback unit 108 communicates the feedback signal to the first combiner element of the encoder 104 when acoustic feedback is identified, a second mode of operation during which the anti-feedback unit 108 communicates the anti-feedback signal to the detector 112 when acoustic feedback is identified, and a third mode of operation during which the anti-feedback unit 108 communicates both the feedback signal to the first combiner and the anti-feedback signal to the detector 112 when acoustic feedback is identified.

The coded signal is communicated to a filter unit 110, which is controlled by the detector 112 receiving the acoustic feedback signal from the anti-feedback unit 108 when the anti-feedback unit 108 identifies an acoustic feedback 114. The detector 112 comprises a noise element for identifying whether the coded signal includes frequency bands comprising external noise. When the noise element detects a noisy frequency band it generates a noise signal. The detector 112 utilises the anti-feedback signal together with the noise signal for generating a control signal for the filter unit 110. The control signal determines a frequency bandwidth of the filter unit 110 thus to be removed from the coded signal so as to generate a filtered signal, shown in FIG. 2*c*.

The filtered signal, shown in FIG. 2*c*, is communicated to a signal processing unit designated in entirety by reference numeral 115. The signal processing unit 115 comprises an amplifier unit 116 subdividing the filtered signal in a number of frequency bands and separately processing each of the frequency bands to individually shape the signal. Hence the term "amplifier unit" is in this context to be construed as a multi-band amplitude compression unit capable of amplifying, equalizing and/or compressing an incoming signal. This allows for provision of an overall gain transfer function, which is adjusted to a user's requirements, such as a hearing impairment. Obviously, the gain transfer function may also be constant through all frequency bands which generally may be applied in headsets or headphones. The amplifier unit 116 generates a shaped signal as shown in FIG. 2*d*.

The signal processing unit 115 further comprises a synthesizer unit 118 receiving the filtered signal from the filter unit 110. The synthesizer unit 118 utilises the filtered signal for transposing second and higher order harmonic bands to the frequency bandwidth, which has been removed by the filter unit 110. The harmonic transposition is made so that the filtered frequency region and synthesized frequency region do not overlap.

The synthesizer unit 118 utilises, as described with reference to FIGS. 4*a* through 4*e*??, a set of defined frequency bands from the filtered input signal for harmonically transposing into the frequency bandwidth, which has been cut out in the filtered signal, as a continuation of a truncated harmonic series.

The amplitude of the transposed bands then has to be adjusted so they reasonably match the spectral envelope of the original coded signal, shown in FIG. 2*b*. For this purpose the synthesizer unit 118 comprises an estimator element for estimating of the spectral envelope of the filtered signal. This estimate is then extrapolated to the transposed bands, and the amplitudes of the transposed bands are adjusted accordingly. The extrapolation may use polynomials together with a set of rules establishing source data. The set of rules may include information regarding gain transfer function of the entire frequency spectrum of the electric signal.

Alternatively, the filter unit 110 provides a complementary signal from an inverted filter characteristic to the estimator element, which complementary signal enables the estimator element to estimate the amplitude of the transposed bands according to, for example, a historic value of the signal within the frequency bandwidth of the complementary signal. The historic value may be established by a running average or a timed logging of the relevant frequency bands. In addition, the spectral envelope may also be estimated from the complementary signal in combination with the extrapolated amplitudes as described above.

The estimator element according to the first embodiment of the present invention has access to the gain transfer function required for a particular user of the hearing aid so as to enable the estimator element to adjust the estimate according to the particular user's hearing impairment.

The synthesizer unit 118 may utilise any number of schemes for transposing the filtered signal known to persons skilled in the art. For example, transposing techniques described in American U.S. Pat. No. 6,680,972, which hereby is incorporated in the present specification by reference.

The synthesizer unit 118 further, similarly, to the amplifier unit 116 amplifies the synthesized signal so that the synthesized signal matches the shaped signal. Alternative configurations of the synthesizer unit 118 are described with reference to FIGS. 3*a*, 3*b*, 4 and 5.

The signal processing unit 115 according to the first embodiment of the present invention further comprises a second combiner element 120 combining the shaped signal with the synthesized signal so as to provide a processed signal, shown in FIG. 2*f*. The processed signal is communicated to a decoder 122 comprising an inverse discrete Fourier transformation element for transforming the processed signal in the frequency domain back into the time domain and a digital to analogue converter element for converting the digital time varying signal to an analogue time varying signal thereby generating a processed time varying output signal, shown in FIG. 2*g*. The processed time varying output signal is forwarded to a driver 124 driving the speaker 126 so as to generate an audio output signal.

Since the shaped signal and the synthesized signal are compensated for a user's hearing impairment the frequency response of the processed signal, shown in FIG. 2*f*, varies from the frequency response of coded signal, shown in FIG. 2*b*. For example, a hearing impairment in the high frequency area will result in the amplitude of the processed signal in the high frequency area is increase relative to the low frequency area.

The encoder 104 and the decoder 122 obviously have to match one another. Thus when the encoder 104 is configured to perform a fast Fourier transform (FFT) on the analogue electric signal before converting into a digital form, then the decoder 122 is configured to perform a conversion into an analogue form before performing an inverse fast Fourier transform. Similarly, a number of encoding techniques may be implemented based on either digital or analogue input signals, for example, discrete cosines transform (DCT).

The anti-feedback unit 108 comprises a howl detection element connecting to the encoder 104. The howl detection element determines whether an acoustic feedback is present in the forward signal path by identifying large peaked sinusoidal signals. When the howl detection element identifies an acoustic feedback tone in the forward signal the anti-feedback unit 108 generates the feedback signal from the processed signal, decoded signal or the converted signal, and communicates the feedback signal to the combiner element in the encoder 104. The anti-feedback unit 108 further comprises a feedback change detection element detecting the effect of the feedback signal. The anti-feedback unit 108 phase-shifts the feedback signal until the acoustic feedback is reduced.

Figure 3A:
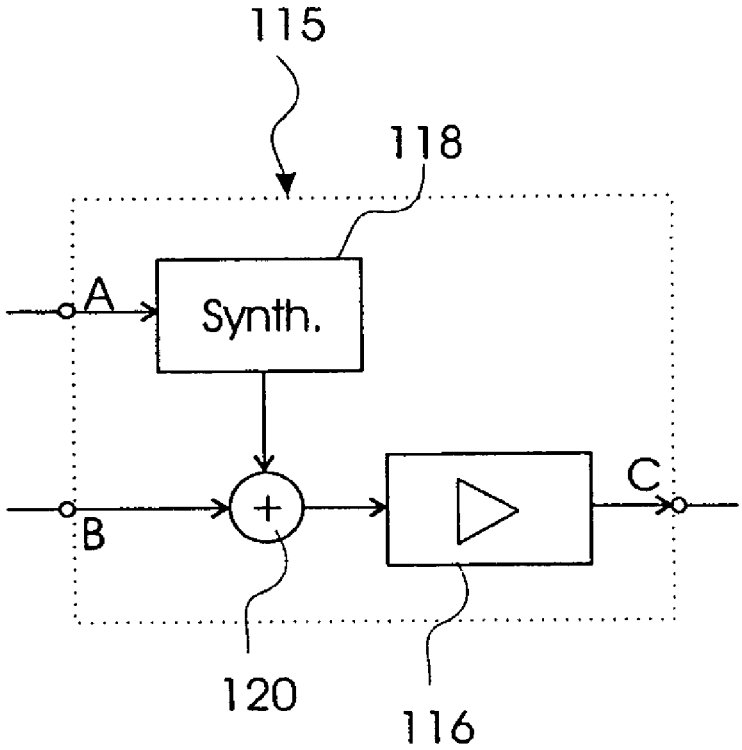
FIGS. 3*a* and 3*b*, show alternative embodiments of signal processing units.

FIG. 3*a* shows an alternative configuration of the signal processing unit 115 described above with reference to FIG. 1. The signal processing unit 115 receives the filtered signal on terminals designated "A" and "B". The terminal "A" is connected to the synthesizing unit 116, which provides the synthesized signal to the second combiner element 120 combining the filtered signal with the synthesized signal prior to the amplifier unit 116 shaping the combined signal.

Figure 3B:
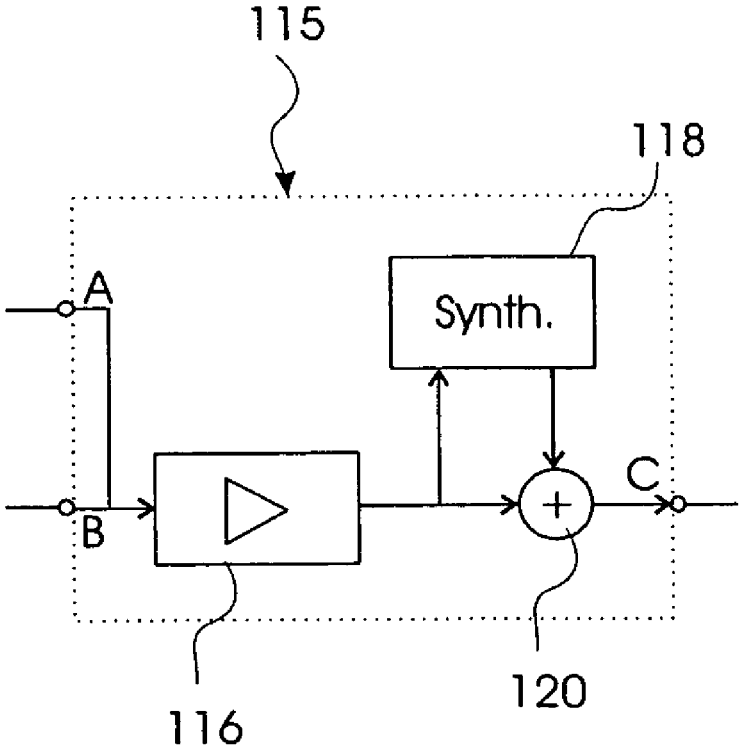

FIG. 3*b* shows a further alternative configuration of the signal processing unit 115 described above with reference to FIGS. 1 and 3*a*. The signal processing unit 115 receives the filtered signal on terminals designated "A" and "B" both being connected to the amplifier unit 116. The shaped signal from the amplifier unit 116 is communicated to the synthesizing unit 118 as well as the second combiner unit 120. The combiner unit 120 combines the shaped signal with the synthesized signal.

Figure 4:
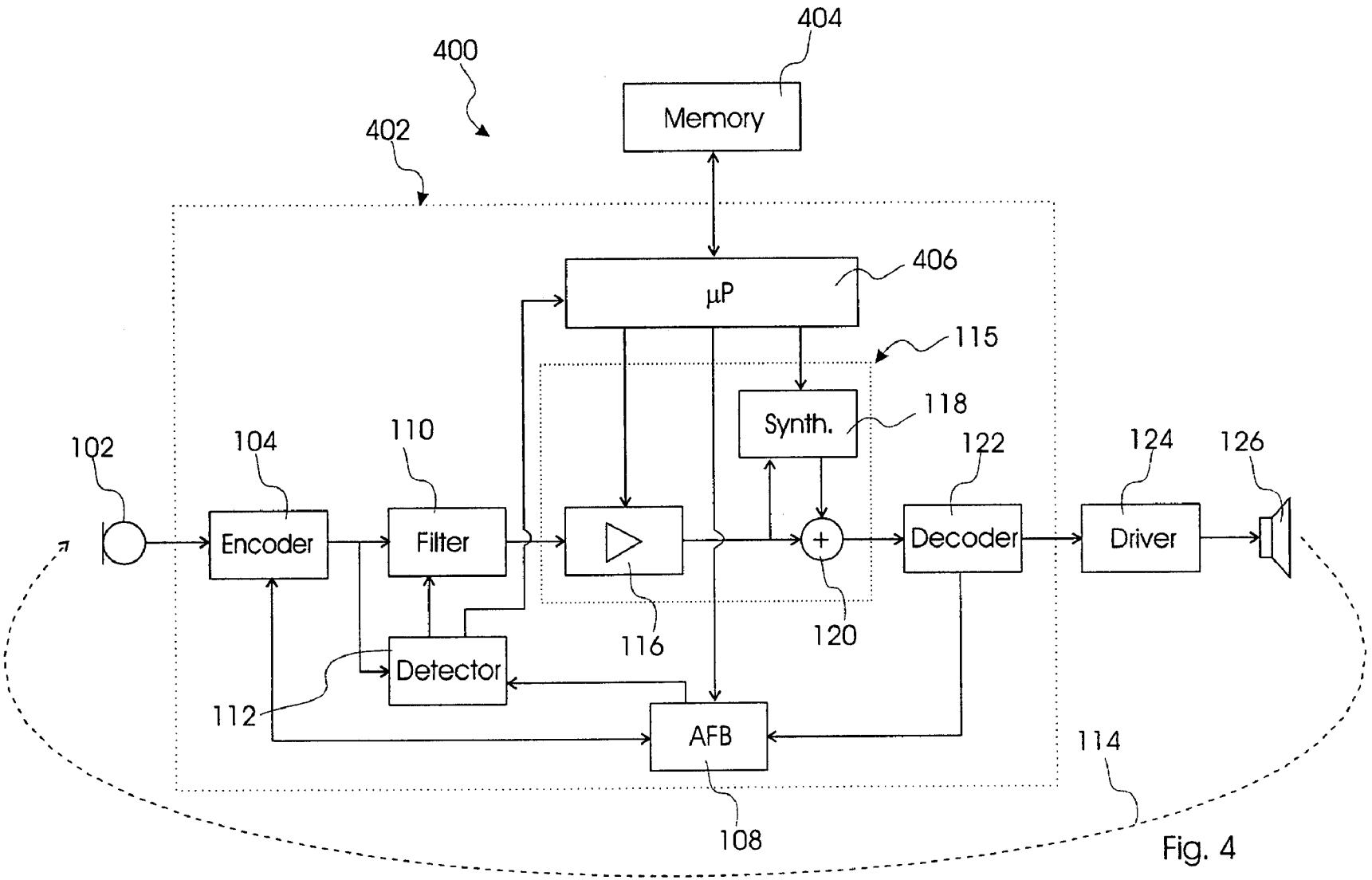
FIG. 4, shows a system for synthesizing an audio input signal of a hearing device according to a second embodiment of the present invention.

FIG. 4 shows a system for synthesizing an audio input signal according to a second embodiment of the present invention, which is designated in entirety by reference numeral 400. Similar elements and units described with reference to FIGS. 1, 3*a* and 3*b* are designated by identical reference numerals.

The system 400 comprises a microphone 102 generating an electric signal to a processing unit 402, which processes the electric signal according to a setting stored in a memory 404 communicating with the processing unit 402. The processing unit 402 generates a processed signal, which is forwarded to a driver 124 driving a speaker 126 to generate an audio output signal.

The processing unit 402 comprises an encoder 104, an anti-feedback unit 108, a filter unit 110 and a detector 112, and a signal processing unit 115 operating as described above with reference to FIG. 1, 3*a* or 3*b*. The detector 112 controls the filter unit 110 and forwards frequency bandwidth information to a controller processor 406 of the processing unit 402. The controller processor 406 utilises the frequency bandwidth information, such as upper and lower frequency of selected bandwidth, to control an amplifier unit 116 in the signal processing unit 115 amplifying the filtered signal received from the filter unit 110. The controller processor 406 controls the amplifier unit 116 according to a setting in the memory 404 thereby generating a shaped signal. The setting may provide control of amplification (increasing or compressing gain) of the filtered signal as well as a frequency response matching a user's desires. The setting may further comprise association with particular acoustic environments in which the user may operate.

The controller processor 406 further controls a synthesizer unit 118 in the signal processing unit 115 receiving the shaped signal and receiving frequency bandwidth information from the controller. Based on this information the synthesizer unit 118 generates a synthesized signal as described with reference to FIG. 1, 2*e*, 3*a*, or 3*b*. Finally, the synthesized signal and the shaped signal, shown in FIG. 2*d*, are combined in a second combiner 120 and decoded by a decoder 122 as described with reference to FIG. 1.

In addition, the controller processor 406 controls the anti-feedback unit 108 so as to switch between operating modes. That is, the controller processor 406 controls whether the anti-feedback unit 108 provides a feedback signal to the encoder 104, an anti-feedback signal to the detector 112, or both. For example, in case the user of system listens to music the anti-feedback unit 108 may be prone to react as if there exists acoustic feedback, hence by program selection by the controller processor 406 the anti-feedback unit 108 is set to operate in the mode only providing an anti-feedback signal to detector 112.

Further, the detector 112 comprises a music detection element for detecting music in the forward signal. The music detector preferably utilises harmonicity detectors, periodicity calculations, calculation of cepstrum flux, spectral centroid estimates or vibrato detectors. If music is detected by the music detection element the detector 112 forwards a music identification signal to the controller processor 406, which controls the anti-feedback unit 108 to stop generating the feedback signal and entirely generate the anti-feedback signal to the detector 112. Thus the prior art feedback cancellation is switched off and the anti-feedback elimination according to the present invention is used instead.

The memory 404 may further comprise data regarding particular frequency bands, which are prone to noise. The controller processor 406 checks whether the setting used by the control processor 406 comprises an associated noise warning in the memory 404.

The synthesizer unit 118 may further be utilised for synthesizing part of the audio input signal, which is cut out throughout the signal path from the microphone 102 to the combiner 120. For example, bandwidth limitations of the amplifier unit may cause higher frequencies of the audio signal to be removed. The synthesizer unit 118 may thus advantageously restore some of these higher frequencies from the basis of the shaped signal to generate second and higher order harmonic bands.

Figure 5:
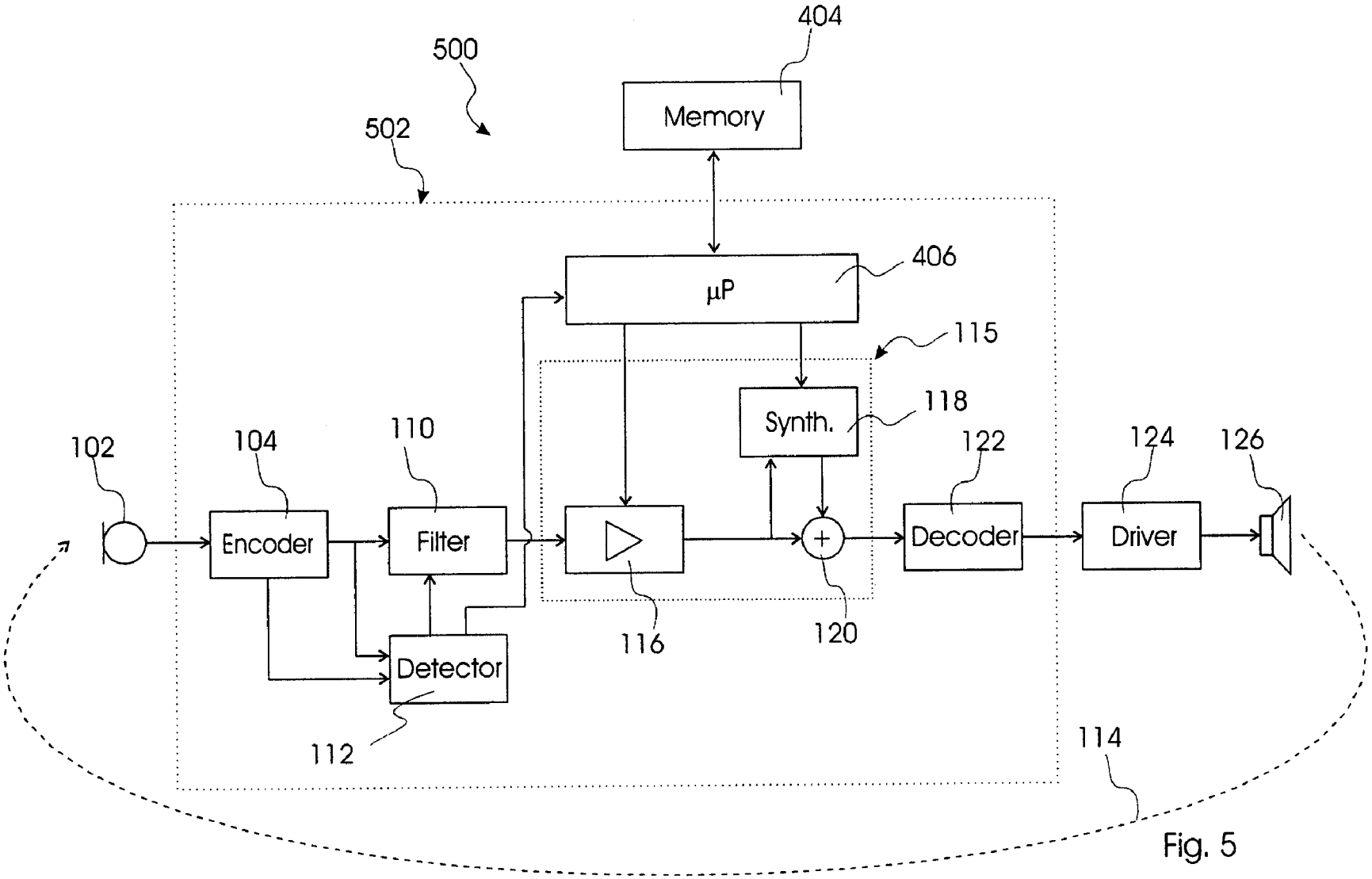
FIG. 5, shows a system for synthesizing an audio input signal of a hearing device according to a third embodiment of the present invention.

FIG. 5 shows a system according to a third embodiment of the present invention, which is designated in entirety by reference numeral 500. Similar elements and units described with reference to FIGS. 1, 3*a*, 3*b*, and 4 are designated by identical reference numerals.

The system 500 operates as described above with reference to FIG. 4, however, the system 500 comprises a processing unit 502, wherein instead of having an anti-feedback unit for generating an anti-feedback signal or feedback signal the processing unit 502 comprises a detector 112 with an howl element determining from the signal in the encoder 104 whether acoustic feedback is present in the forward signal path. Hence the system 500 entirely utilises the signal processing unit 115 for eliminating acoustic feedback; that is by removal and synthesis of a frequency bandwidth.

Figure 6A:
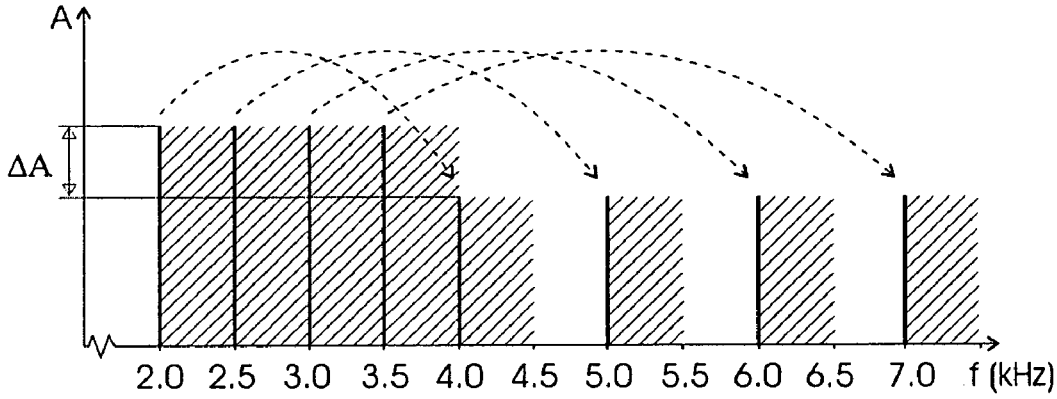
FIGS. 6*a* through 6*d*, show graphs of effect of transposition in the frequency domain.

FIG. 6*a* shows a graph of a first example of a transposition of source frequency bands 2.0 to 2.5; 2.5 to 3.0; 3.0 to 3.5; and 3.5 to 4.0 kHz to four resultant frequency bands in a frequency bandwidth between 4.0 and 7.5 kHz. In this first example the lower cut-off frequencies of the source frequency bands i.e. 2.0, 2.5, 3.0, and 3.5 kHz are used as first order harmonic frequency reference for transposing the source frequency bands to corresponding resultant frequency bands having lower cut-off frequencies determined as second order harmonics of the lower cut-off frequencies of the source frequency bands. Thus the resultant frequency bands are 4.0 to 4.5; 5.0 to 5.5; 6.0 to 6.5; and 7.0 to 7.5 kHz.

The resultant frequency bands have amplitudes, which are determined according preferred embodiment of the present invention by applying any extrapolation techniques known to person skilled in the art, and shown as a change $\Delta A$ in FIG. 6*a*, utilising information in the non-filtered source part of the signal. The amplitudes of the resultant frequency bands are according to an alternative embodiment of the present invention determined by extrapolation techniques utilising information in the filtered part of the original signal, however, using this approach care should be taken to avoid re-establishing the signal to a form which caused the filter 110 to cut away a part of the signal, such as acoustic feedback or external noise.

Figure 6B:
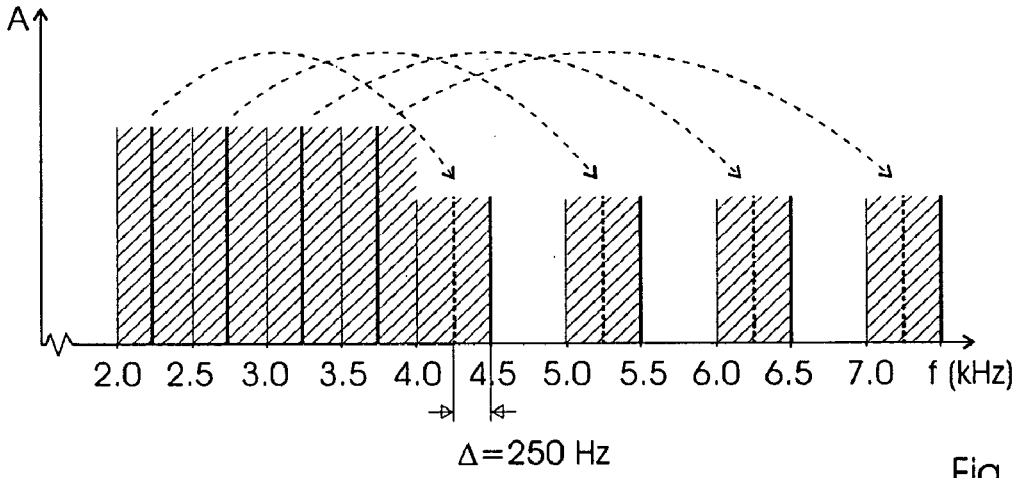

FIG. 6*b* shows a second graph of the first example illustrating an error $\Delta$, which is introduced during transposition. The transposition of frequency bands based on a single reference frequency in the source frequency bands introduce this error Δ due to the relationship between bandwidth of source frequency band and bandwidth of ideal resultant frequency band. The bandwidth of the second order resultant frequency band is doubled relative to the source frequency band bandwidth and the third order resultant frequency band is tripled relative to the source bandwidth.

As shown in FIG. 6*b* the first centre frequency of the source frequency band 2.25 kHz transposed to second order resultant frequency bands introduces an error Δ of 250 Hz, since the centre frequency of the source frequency band ideally should transpose to the second order harmonic 4.5 kHz, but is transposed to 4.25 kHz. However, the users' of the hearing device sensitivity to this error Δ varies greatly, for example, hearing impaired do not show great sensitivity of the error Δ, and therefore this example of transposition may be implemented in hearing aids. It is well known that a healthy auditory system cannot discriminate two tones if they differ in frequency by less than five percent of the critical bandwidth, therefore an approximation of an exact transposition may be used where a bandwidth is chosen so the error Δ does not exceed about five percent of the critical bandwidth in the region of the transposed band.

This approximation may be made dependent on the hearing loss of the user of a hearing device, since the critical bandwidths are broader for sensorineural hearing impaired persons. Hearing impairment may give broadened critical band filters by an amount of up to six times normal critical bandwidth. Thus, errors Δ can be chosen to be up to about 30% of the critical bandwidth in the region of the transposed band, depending on the hearing loss.

An arbitrary number of harmonically related bands can be created from one frequency band within the unfiltered frequency region. For example the second, third and fourth harmonics can be created from one of the frequency bands.

The harmonic extrapolation is made so that the filtered frequency region and synthesized frequency region do not overlap.

Obviously, the source reference frequency may be selected anywhere within the source frequency band so as to reduce the error Δ as much as possible. For example by using the centre frequency of the source frequency bands as reference frequency for the transposition of frequency bands the error Δ is spread to both sides of the resultant frequency band.

Figure 6C:
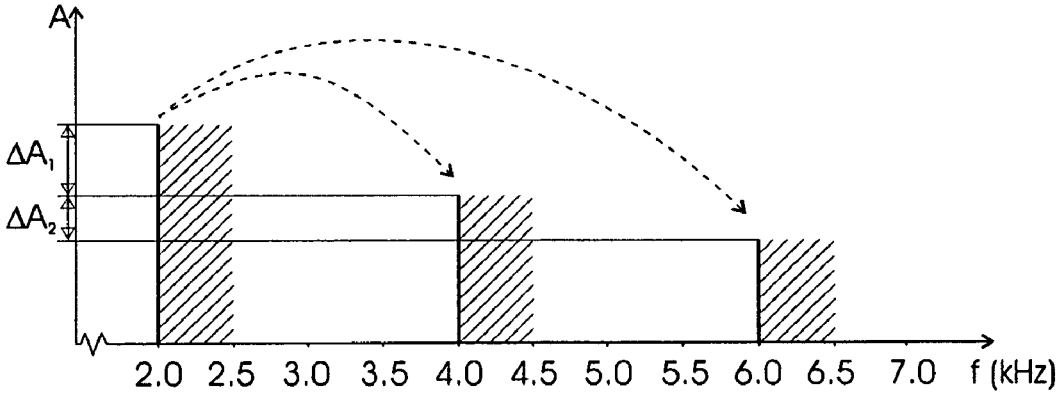

FIG. 6*c* shows a graph of a second example of a transposition of a source frequency band between 2.0 and 2.5 kHz utilising a lower cut-off frequency as reference first order harmonic frequency. The source frequency band is transposed to second and third harmonics of the reference frequency to the frequency bands 4.0 to 4.5 and 6.0 to 6.5 kHz. The amplitudes of the transposed frequency bands are determined according to any extrapolation known to persons skilled in the art and may include compensation for particular customer related preferences, such as hearing impairments of a user. The amplitude changes are designated by $\Delta A_1$ and $\Delta A_2$.

This example of transposition shows a beneficiary method for extending bandwidth in situations where the bandwidth limitation is caused by frequency limitations of components in the systems, since the bandwidth may be extended to the overall system in addition to the anti-feedback and noise elimination.

Figure 6D:
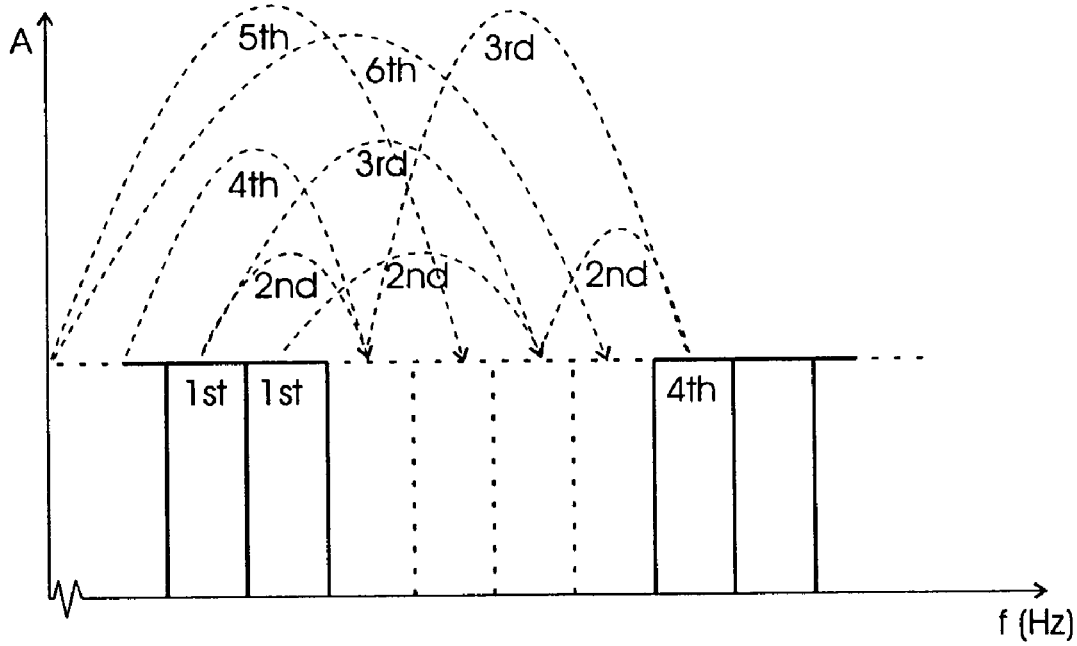

FIG. 6*d* shows a further example of transposition of source frequency bands to an area of the frequency bandwidth, which has been removed by the filter 110. The example illustrates how the source frequency bands overlap one another by overlapping second, third, fourth, fifth and sixth harmonic bands into the resultant frequency bands in the filtered-out area.

The structure of the frequency bands is continued through the filtered-out area, thus allowing for downward frequency transposition for higher order frequency source bands to lower order resultant frequency bands, shown in FIG. 6*d* by a fourth order harmonic source frequency band being downward transposed to third and second order harmonic resultant frequency band.

Any of the above examples of transposition and in fact any combination thereof may be implemented in a system as described with reference to FIGS. 1, 3*a*, 3*b*, 4 and 5.

Figure 7:
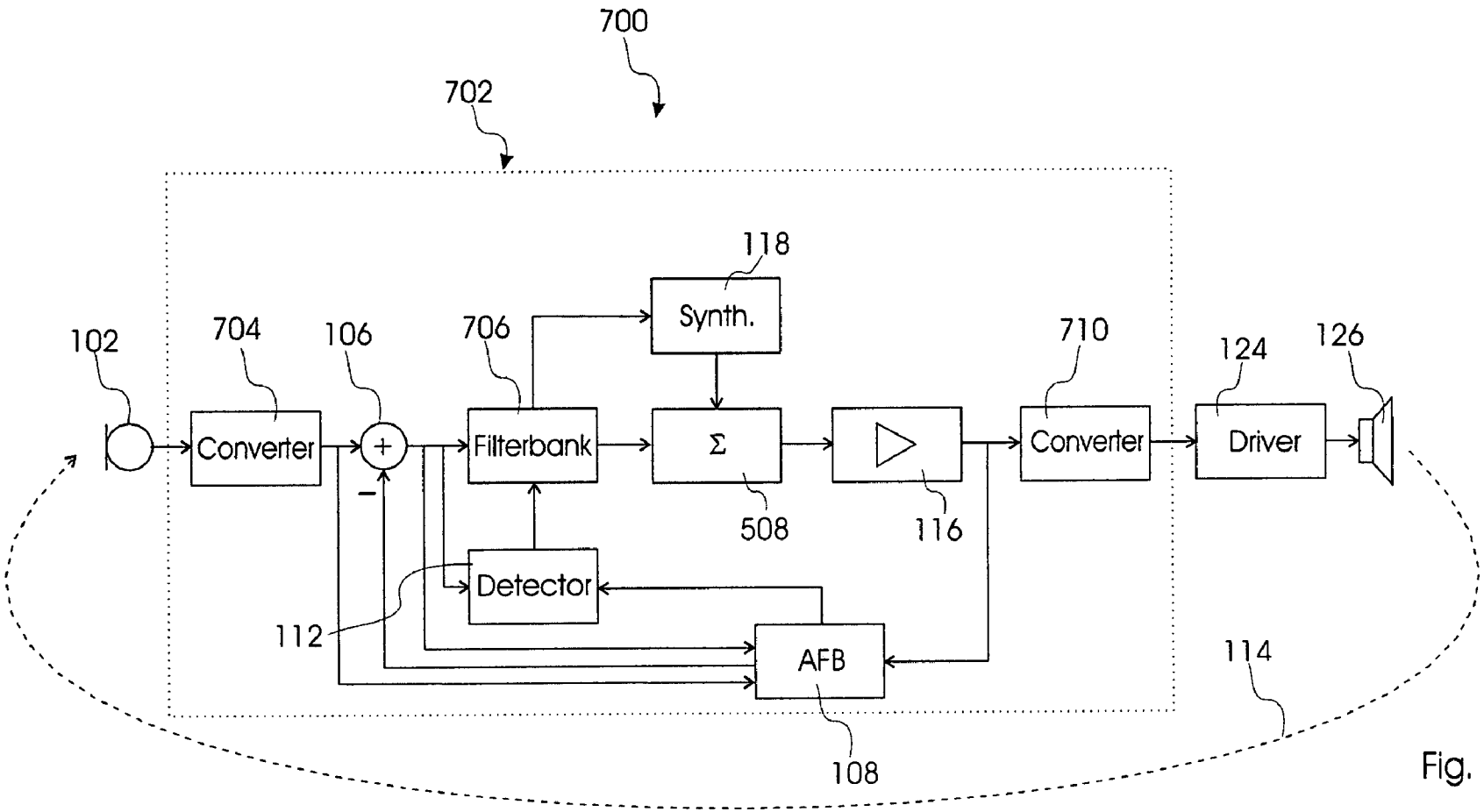
FIG. 7, shows a system for synthesizing an audio input signal of a hearing device according to a third embodiment of the present invention.

FIG. 7 shows a system for synthesizing an audio input signal according to a fourth embodiment of the present invention, which is designated in entirety by reference numeral 700. Similar elements and units described with reference to FIGS. 1, 3*a*, 3*b*, 4 and 5 are designated by identical reference numerals.

The system 700 comprises a microphone 102 generating an electric signal to a signal processing unit 702 processing the electric signal according to a setting. The signal processing unit 702 generates a processed signal, which is forwarded to a driver 124 driving a speaker 126 to generate an audio output signal.

The signal processing unit 702 comprises a first converter unit 704 converting the electric signal from analogue to digital in time domain. In an alternative embodiment the first converter is an external unit interconnecting the microphone 102 and the signal processing unit 702.

The signal processing unit 702 further comprises a first combiner 106, anti-feedback unit 108, and detector 112 operating as described above with reference to FIG. 1. The detector 112 controls a filter bank 706 separating the electric signal into a plurality of frequency bands. The detector 112 forwards frequency bandwidth information, such as upper and lower frequency of a selected bandwidth to be blocked, to the filter bank 706, which based upon the frequency bandwidth information controls which frequency bands are to be passed and which are to be blocked.

The filter bank 706 forwards frequency band information to a synthesizer unit 118. The synthesizer unit 118 generates a synthesized signal based on a multiplication of a complex sinusoidal signal (i.e. complex band shifting, transposition, as described above). Contrary to the above described embodiments of the present invention the synthesizer unit 118 utilises complex to real data conversion as for example described in "Handbook of digital signal processing" by D. F. Elliot, Academic Press Inc., San Diego 1987.

The synthesizer unit 118 forwards the synthesized signal to a summer unit 708 summing the passed frequency bands from the filter bank 706 with the synthesized frequency bands from the synthesizer unit 118. The combined signal generated by the summer unit 708 is forwarded to an amplifier unit 116 processing each of the frequency bands of the combined signal so as to provide a shaped signal to a second converter 510 converting the shaped signal back to analogue form thereby providing a processed signal for the driver 124.

Figure 8:
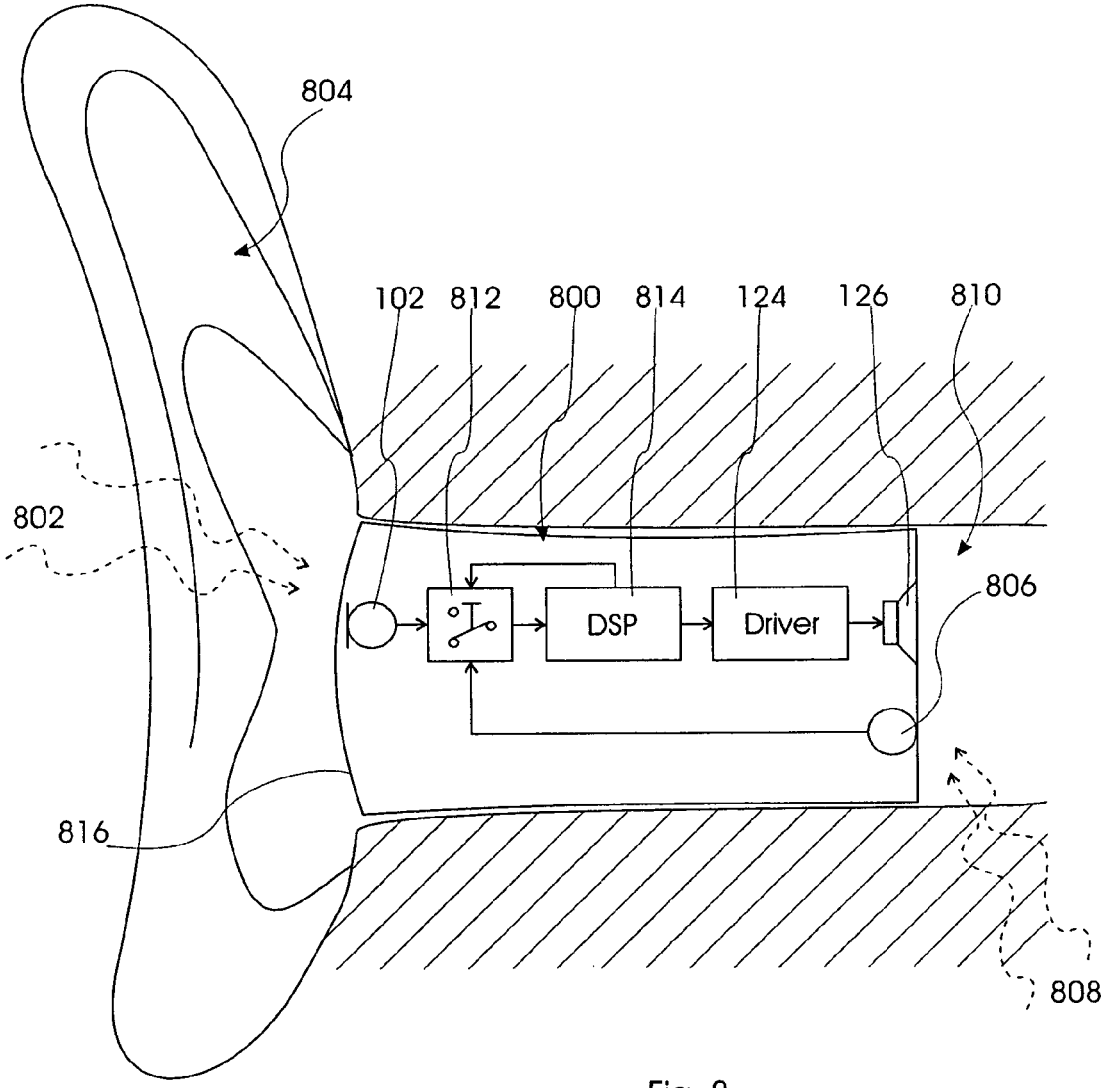
FIG. 8, shows a system for synthesizing an audio input signal of a hearing device according to a fourth embodiment of the present invention.

FIG. 8 shows a system according to a fifth embodiment of the present invention, which system is designated in entirety by reference numeral 800. This system 800 comprises a first microphone 102 for receiving an external audio signal 802 from the external area of the ear 804 of a user of the system 800, and a second microphone 806 for receiving an internal audio signal 808 from the internal area of the ear, namely the ear canal 810 of the user of the system 800. The first and second microphones 102, 806 connect to a switching unit 812, which is controlled by a signal processing unit 814 in a first switching position wherein the first microphone 102 is connected to the input of the signal processing unit 814 and in a second switching position wherein the second microphone 806 is connected to the input of the signal processing unit 814.

The signal processing unit 814 comprises encoder/converter, filter unit/bank, amplifier unit, synthesizer unit and decoder/converter configured as described with reference to any of FIGS. 1, 3*a*, 3*b*, 4, 5 and 7. Hence the signal processing unit 814 may be operated in the manner described with reference to either of the systems 100, 400, 500 and 700 or in fact any combination thereof.

Thus the signal processing unit 814 determines whether the external or internal audio signals 802, 808 is to be input as an electric signal to the signal processing unit 814. When the external audio signal 802 is input to the signal processing unit 814, the signal processing unit 814 operates as described with reference to the systems 100, 400, 500 and 700. However, when the internal audio signal 808 is input to the signal processing unit 814 as an electric signal, the synthesizer unit of the signal processing unit 814 synthesizes second and higher order harmonics based on the electric signal. That is, the original audio signal recorded by the second microphone 806 is used as basis for further introduction of new higher order harmonics and thus the audio fidelity is improved.

The internal audio signal 808 comprises audio sounds transmitted through tissue and bones. The internal audio signal 808 therefore generally is a low pass version of the same audio signal transmitted through air. Thus the synthesizer unit of the signal processing unit 814 may advantageously reconstruct the high frequency elements of a user's own voice transmitted through the user's tissues and bones, and therefore the user of for example a hearing aid is presented with a sound of own voice, which is more agreeable to the user.

The system 800 further comprises a driver 124 and speaker 126 for presenting sound to the user, and comprises a housing 816 for encapsulating the system 800.

It is to be understood that either of the features of the systems according to the first, second, third, and fourth embodiment of the present invention may be interchanged so as to accomplish any required configuration necessitated. Hence any particular configuration of the synthesizer unit 118 shown in FIGS. 1, 3*a*, 3*b*, 4, 5, and 7 may be used in any of the systems 100, 400, 500 and 700.

Similarly, it is to be understood that any of the systems according to the first, second and third embodiment of the present invention may incorporate a controller processor as well as memory, as shown in FIGS. 4 and 5.

The invention claimed is:

1. A system for synthesizing an audio input signal of a hearing device and comprising a microphone unit adapted to convert said audio input signal to an electric signal, a filter unit adapted to remove a selected frequency band of said electric signal and pass a filtered signal, a synthesizer unit adapted to synthesize said selected frequency band of said electric signal based on said filtered signal thereby generating a synthesized signal, a combiner unit adapted to combine said filtered signal and said synthesized signal thereby generating a combined signal, and an output unit adapted to convert said combined signal to an audio output signal.

2. A system according to claim 1, wherein said filter unit is configurable as a low-pass, a high-pass, a band-pass, a notch filter, or any combination thereof.

3. A system according to any of claims 1, wherein said filter unit is configurable as an $n^{th}$ order finite or infinite impulse response (IIR) filter (such as a $2^{nd}$, $3^{rd}$, or $4^{th}$ order Chebychev or Butterworth), a wave-digital, or any combination thereof.

4. A system according to any of claims 1, wherein said filter unit is configurable as a filter bank muting selected frequency bins of a frequency transformation, such as fast Fourier transformation (FFT), discrete Fourier transformation (DFT) or discrete cosine transformation (DCT).

5. A system according to claim 1 further comprises an amplifier unit interconnecting said combiner unit and said output unit, and adapted to process said combined signal before communicating said combined signal to said output unit.

6. A system according to claim 5, wherein said amplifier unit comprises a digital signal processor comprising a frequency selecting means adapted to select a processing frequency band of said filtered signal and an adjusting means adapted to increase or compress gain in said processing frequency band.

7. A system according to claim 6, wherein said frequency selecting means comprises a filter bank element adapted to separate said electric signal into a plurality of time varying electric sub-signals.

8. A system according to claim 6, wherein said digital signal processor incorporates said synthesizer unit.

9. A system according to claim 1 further comprises an amplifier unit interconnecting said filter unit and said combiner unit, and adapted to process said filtered signal before communicating said filtered signal to said combiner unit and/or said synthesizer unit.

10. A system according to claim 1 further comprises an encoder unit interconnecting said microphone unit and said filter unit, and may be adapted to code said electric signal to a coded signal.

11. A system according to claim 10, wherein said encoder unit comprises a converter element adapted to convert said electric signal form analogue to digital form and comprises a coding element adapted to transform said electric signal from a time domain to a frequency domain.

12. A system according to claim 10, wherein said encoder element comprises a time-to-frequency transformer such as a fast Fourier transformation (FFT) element, a discrete Fourier transformation (DFT) element, or discrete cosine transformation (DCT) element.

13. A system according to claim 1, wherein said output unit comprises a decoder unit adapted to decode said combined signal to a decoded signal.

14. A system according to claim 13, wherein said decoder unit comprises a converter element adapted to convert said coded signal from digital to analogue and comprises a decoding element adapted to transform said combined signal from a frequency domain to a time domain.

15. A system according to claims 14, wherein said decoding element comprises a frequency-to-time transformer such as an inverse FFT, DFT or DCT element adapted to transform said combined signal from said frequency domain into said time domain.

16. A system according to claim 1, wherein said synthesizer unit comprises a calculation element adapted to calculate harmonic frequencies in said selected frequency band of a selected reference frequency in a defined frequency band of said filtered signal, and a generator element adapted to transpose said defined frequency band to harmonic frequencies in said selected frequency band thereby generating said synthesized signal.

17. A system according to claim 1, wherein said synthesizer unit comprises a calculation element adapted to calculate an estimated frequency response of said selected frequency band from a complementary signal from said filter unit, which complementary signal comprises filtered out part said filtered signal.

18. A system according to claim 17, wherein said estimated frequency response is calculated from running average of said frequency response in the entire frequency bandwidth of said system, and/or of said selected frequency band.

19. A system according to claim 17, wherein said synthesizer unit further comprises a generator element adapted to generate a synthesized signal represented by said estimated frequency response.

20. A system according to claim 1 further comprises a controller processor adapted to control said amplifier unit and said synthesis unit according to a predefined setting.

21. A system according to claim 1 further comprises a detector unit having an acoustic feedback detector adapted to monitor an anti-feedback unit adapted to identify acoustic feedback, and having a control signal generator adapted to generate a control signal for said filter unit for controlling said selected frequency band.

22. A system according to claim 21, wherein said acoustic feedback detector comprises one or more pure-tone detector elements.

23. A system according to claim 21, wherein said detector unit incorporates a pre-defined frequency band, and further may communicate said control signal to said controller processor selecting a setting according to said control signal.

24. A system according to claim 21, wherein said detector unit further comprises a noise detector adapted to identify external noise, and wherein said control signal generator is further adapted to generate said control signal for said filter unit according to said external noise.

25. A system according to claim 21, wherein said detector unit further comprises a music detecting element adapted to detect music in said electric signal.

26. A synthesizer unit for synthesizing a selected frequency band of an electric signal based on a filtered signal for use in a system according to claim 1.

27. A method for synthesizing an audio input signal of a hearing device and comprising converting said audio input signal to an electric signal by means of a microphone unit, removing a selected frequency band of said electric signal and passing a filtered signal by means of a filter unit, synthesizing said selected frequency band of said electric signal based on said filtered signal thereby generating a synthesized signal by means of a synthesizer unit, combining said filtered signal and said synthesized signal thereby generating a combined signal by means of a combiner unit, and converting said combined signal to an audio output signal by means of an output unit.

28. A computer program embodied on a non-transitory computer readable medium to perform steps of a method according to claim 27.

* * * * *